US006597115B2

(12) United States Patent
Goto et al.

(10) Patent No.: US 6,597,115 B2
(45) Date of Patent: Jul. 22, 2003

(54) LIGHT SOURCE DEVICE

(75) Inventors: Kazuhiro Goto, Himeji (JP); Akihiko Sugitani, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 28 days.

(21) Appl. No.: 09/984,910

(22) Filed: Oct. 31, 2001

(65) Prior Publication Data

US 2002/0050774 A1 May 2, 2002

(30) Foreign Application Priority Data

Oct. 31, 2000 (JP) ..... 2000-332089

(51) Int. Cl.[7] ..... H01J 17/04

(52) U.S. Cl. ..... 313/631; 313/621; 313/622; 313/574

(58) Field of Search ..... 313/113, 571, 313/574, 575, 576, 637, 638, 639, 641, 642, 643, 631, 620, 621, 622

(56) References Cited

U.S. PATENT DOCUMENTS 4,742,268 A * 5/1988 Caruso et al. ..... 313/620
4,988,918 A * 1/1991 Mori et al. ..... 313/641
5,229,681 A * 7/1993 Gordin et al. ..... 313/25
6,060,830 A 5/2000 Sugitani et al.
6,271,628 B1 8/2001 Sugitani et al.
6,274,983 B1 * 8/2001 Ooyama et al. ..... 313/632

FOREIGN PATENT DOCUMENTS

EP 0 973 187 A1 1/2000
EP 1 107 286 A1 6/2001

* cited by examiner

*Primary Examiner*—Robert H. Kim
*Assistant Examiner*—Elizabeth Gemmell
(74) *Attorney, Agent, or Firm*—Nixon Peabody LLP; David S. Safran

(57) ABSTRACT

A light source device for a video monitor including a concave reflector with a middle opening and an optical axis, said optical axis being positioned tilted obliquely and a discharge lamp including an emission part with a cathode and an anode located opposite to one another and being supported by hermetically sealed portions, one of the hermetically sealed portions being mounted in the middle opening of the concave reflector in a manner that a lengthwise axis of the discharge lamp substantially aligns with the optical axis of the concave reflector, where the anode of the discharge lamp is positioned closer to the rear reflector than the cathode of the discharge lamp, and a tip of the anode is positioned underneath an obliquely tilted plane that includes the lengthwise axis of the discharge lamp.

12 Claims, 4 Drawing Sheets

LIGHT SOURCE DEVICE

BACKGROUND OF THE INVENTION

1. Field of the Invention

The invention relates to a light source device for a data projector, a liquid crystal projector, or a DLP projector.

2. Description of Related Art

Recently, a liquid crystal projector and a DLP projector have increasingly come into use which incorporate digital-light-processing technology (DLP™ from Texas Instruments). In these projectors, a so-called video monitor of the front projection type is used in which monitor light from a projector is projected onto a screen which is located at a distance from the above described projector. They are used by increasing the radiance of the light source and by improving the degree of light utilization of the liquid crystals and DLP, even in bright spaces. Furthermore, recently a so-called video monitor of the rear projection type or rear projection system as a monitor such as a television for home use in which a light source device and a screen are made integral with one another, has become more and more popular.

FIGS. 1(*a*) and 1(*b*) schematically show a conventional video monitor of the rear projection type 100 in a cross section. In the video monitor of the rear projection type 100, a light source device 200, optical parts 6 of the illumination system, a rear reflector 3 and a screen 4 are provided in a cage-like body 5.

The light source for a video monitor of the rear projection type is a short arc discharge lamp such as a metal halide lamp, a super-high pressure mercury lamp, or the like. The trend is for the thickness of a video monitor from the rear projection type to become smaller based on the market demands for saving space.

There are many cases in which according to the continuing increase in radiance, the above described super-high pressure mercury lamp is used as the light source. Since in a super-high pressure mercury lamp, a higher mercury operating pressure can be achieved by vertical luminous operation than by horizontal luminous operation, vertical luminous operation is desirable. In addition, in a super-high pressure mercury lamp by vertical luminous operation, a heat-resistant construction of the arc tube can be enabled with relative ease, with consideration of the lamp properties, such as the increase of radiance, prolongation of the service life and the like, thereby making vertical luminous operation especially desirable.

In FIG. 1(*a*), the screen 4 is vertical. To form a quadratic projection surface on the screen 4 in which the top and the bottom are the same size, the projection distance between the light source and the top side of the screen 4, and the projection distance between the light source and the bottom of the screen 4, must be the same size. When these distances are different, a trapezoidal projection surface is formed on the screen 4. When the rear reflector 3 is tilted to a great degree to eliminate the above described defect, the depth of the video monitor of the rear projection type 100 becomes large as shown in FIG. 1(*a*).

Therefore, as shown in FIG. 1(*b*), an approach was found to tilting the illumination light by means of the optical parts 6 of the illumination system while maintaining vertical luminous operation of the discharge lamp 1. But for this reason, there had to be more optical parts 6 of the illumination system in the cage-like body 5 of the product which reduces the degree of freedom of the arrangement of the rear reflector 3. As a result, the disadvantage was that it is difficult to reduce the thickness of the video monitor of the rear projection type.

SUMMARY OF THE INVENTION

FIG. 2 shows a video monitor of the rear projection type 100 in which the operating position of the light source device 200 is tilted with respect to vertical, making it possible to reduce the number of optical parts 6 of the illumination system which contain a direction limiting mirror, a prism and the like, as compared to the case of vertical luminous operation of the light source device 200 as shown in FIG. 1(*b*). Thus, the arrangement of the rear reflector 3 is simplified and the thickness of the video monitor of the rear projection type 100 is more easily reduced.

By reducing the number of optical parts of the illumination system 6 the cost can furthermore be reduced.

For the above described reasons, with respect to the implementation of a thickness-reducing construction of the product, there is a great market potential for luminous operation of the discharge lamp 1 of the light source device 200 tilted with respect to vertical luminous operation in the manner shown in FIG. 2.

However, the present inventors have found a limitation in the above described case of tilted luminous operation of the light source device 200, in that there is a disadvantage of the continued existence of a coil arc as compared to vertical luminous operation. Usually, for the cathode of the discharge lamp 1 under consideration, the cathode is wound with a component which is called the coil which serves as the starting point for the arc. After starting the discharge lamp, the coil loses its primary function and the hot spot of the arc is shifted from the coil to the tip of the upholding part of the cathode according to the increase of operating pressure in the arc tube. The above described disadvantageous phenomenon of continued existence of the coil arc is when the above described shift of the hot spot of the arc from the coil, to the tip of the upholding part of the cathode, does not take place. Instead, in coil arc, the discharge remains stable, not between the electrode tips where actually the arc gap should be, but the discharge remains stable between the coil and the anode. The coil is, however, a component which is necessary for facilitate starting the discharge lamp.

In a discharge lamp which is operated using a direct current, the cathode and the anode are heated along the lengthwise axis, sealed and thus secured. But since the anode has a greater weight than the cathode, a slight eccentricity forms on the tip of the upholding part of the anode with respect to the lengthwise axis of the lamp. Between this eccentric tip of the upholding part of the anode, and the coil with which the cathode is wound, the arc shifts during luminous operation. There are cases in which the generated coil arc continues to exist depending on the position of the eccentric tip of the upholding part of the anode.

When a coil arc forms, the focussing point of the concave reflector and the middle position of the arc diverge from one another so that sufficient utilization of the light intensity as a light source becomes more difficult. Furthermore, as a result of the continued existence of the coil arc, the tungsten which comprises the coil vaporizes. The vaporized material is deposited on the inside wall of the arc tube which consists of quartz glass, and the transmittance of the emission part is reduced. This results in the disadvantages that the light intensity on the projection surface is attenuated. In addition, the emission part is deformed as a result of the local temperature increase and thus, the lamp properties are adversely affected.

In view of the above, the primary object of the present invention is to devise a light source device in which, in a discharge lamp used for the light source device of a video monitor of the rear projection type, uninterrupted formation of a coil arc is prevented thereby prolonging the service life of the lamp. Another object of the present invention is to reduce the number of optical parts of the video monitor of the rear projection type, and to reduce its production costs.

In accordance with one embodiment of the described invention, in a light source device used for an irradiation light source of a video monitor of the rear projection type in which the emitted video light is reflected by a rear reflector located tilted in the horizontal direction and is emitted onto an essentially vertical screen, the advantages are attained in that the above described light source device comprises a concave reflector, and a discharge lamp with an arc tube with an emission part and hermetically sealed portions adjoining it laterally. The discharge lamp is operated using a direct current and is mounted with the hermetically sealed portion in a center opening of the above described concave reflector. In the arc tube, there are a pair of electrodes, specifically a cathode and an anode, opposite one another, so that the optical axis of the concave reflector is positioned tilted from the vertical direction essentially in the direction of the rear reflector, preferably toward its middle, so that the discharge lamp of the direct current luminous operation type is arranged with its anode at the top, and that the tip of this anode is positioned with respect to the lengthwise axis of the lamp, towards the side on which the above described light source device is tilted.

The primary object is furthermore achieved in another embodiment by the tilt angle of the above described light source device to the vertical axial direction preferably being greater than or equal to 5 degrees, and less than or equal to 50 degrees.

The primary object is moreover achieved in yet another embodiment by the lamp wattage of the above described discharge lamp of the direct current luminous operation type being preferably greater than or equal to 100 W. In still another embodiment, the above described arc tube contains greater than or equal to 0.16 mg/mm$^3$ mercury, and a rare gas or a rare gas and halogen. In yet another embodiment, the primary object is also achieved by having the wall load of the discharge lamp greater than or equal to 0.8 W/mm$^2$.

These and other objects and advantages of the present invention will become more apparent from the following detailed description of the invention when viewed in conjunction with the accompanying drawings.

DETAILED DESCRIPTION OF THE PREFERRED EMBODIMENT

Figure 2:
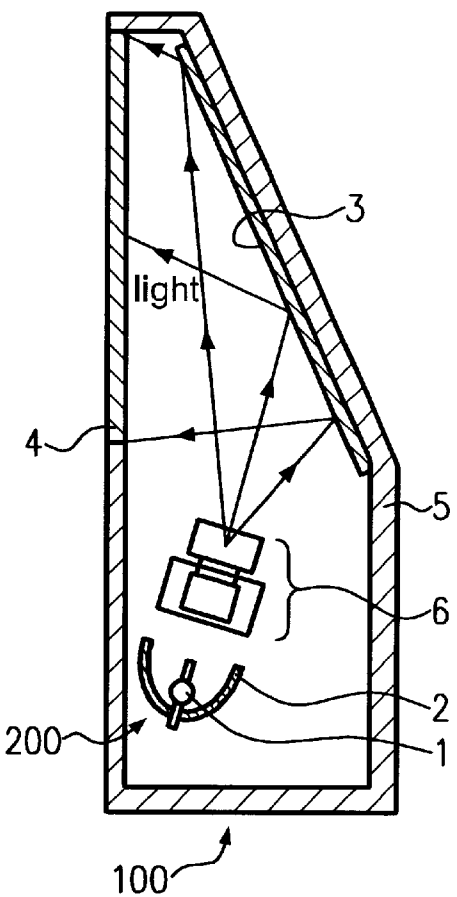
FIG. 2 shows a schematic cross section of a video monitor of the rear projection type in which there is a light source device in accordance with one embodiment of the present invention.
Figure 1B:
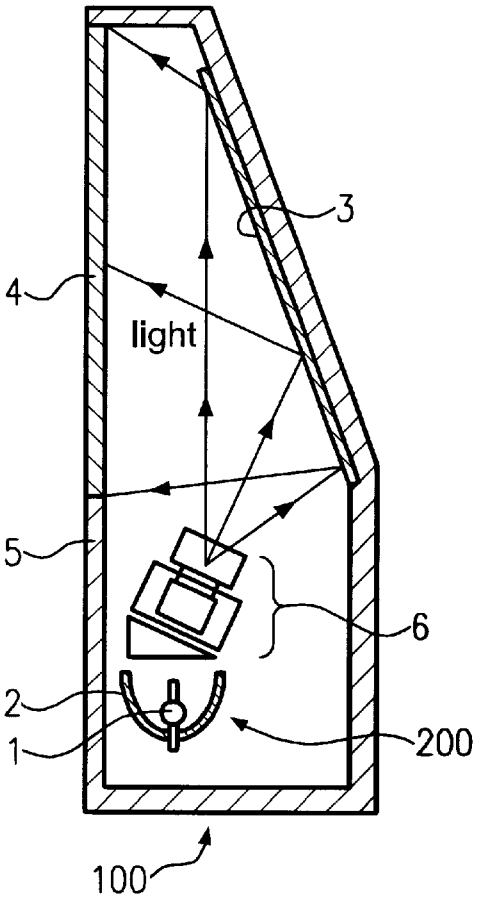
Fig.1(b) (Prior Art)
FIGS. 1(*a*) and 1(*b*) each show a schematic cross section of a prior art video monitor of the rear projection type.
Figure 1A:
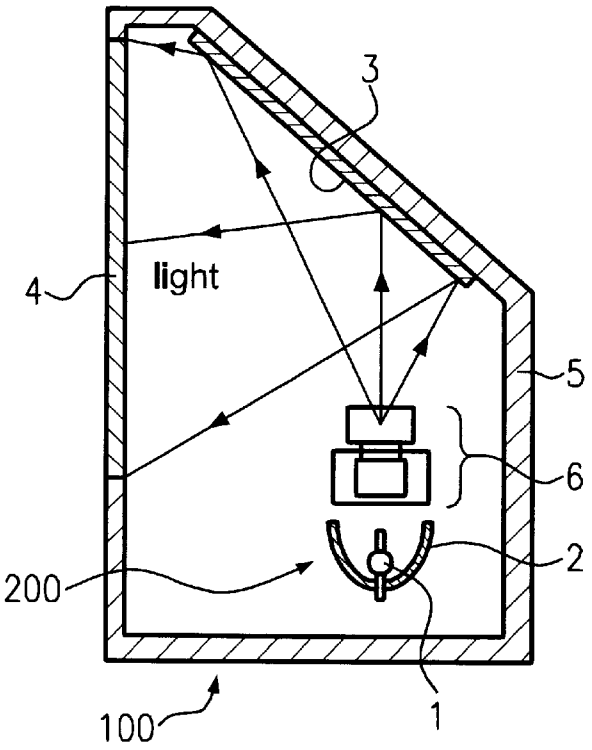
Fig.1(a) (Prior Art)
Figure 3:
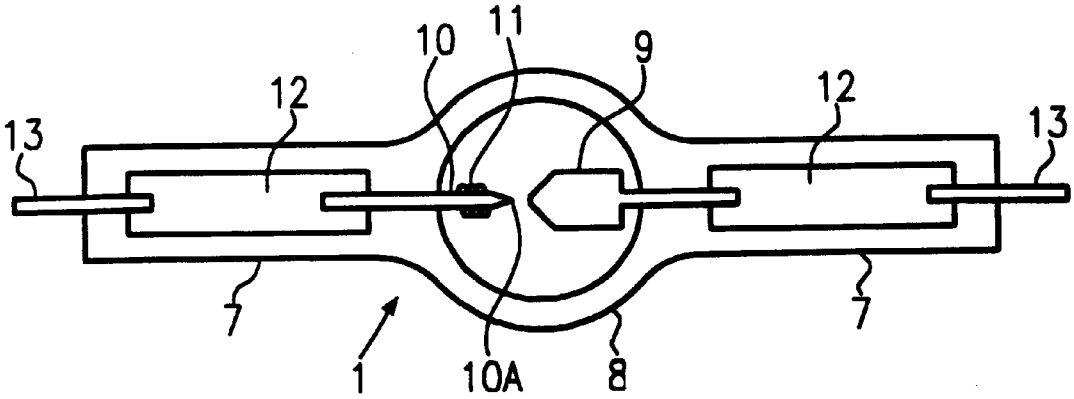
FIG. 3 shows a schematic illustration of a super-high pressure mercury lamp.

FIG. 3 is a schematic of a super-high pressure mercury discharge lamp 1 of the direct current luminous operation type in accordance with one embodiment of the present invention. It should be noted that whereas the present invention is described herein below as applied to a preferred embodiment of a mercury discharge lamp 1, it should be initially understood that the present invention may also be applied to other types of discharge lamps as well and the present invention is not limited to mercury discharge lamps. The discharge lamp 1 may be made of quartz glass and has an oval emission part 8 which forms an emission space as well as rod-shaped hermetically sealed portions 7 which are located on the emission part 8 such that they extend toward the outside from ends of the emission part 8. In the emission part 8, there are an anode 9 and a cathode 10 opposite one another on the lengthwise axis of the discharge lamp 1. In the illustrated example, the distance between these electrodes is less than or equal to 2.0 mm. In the cathode 10, the axial area extends into the hermetically sealed portion 7 and is electrically connected to an outer lead 13 via a molybdenum foil 12 which is hermetically enclosed in the hermetically sealed portion 7. The anode 9 has a similar arrangement and is likewise electrically connected to an outer lead 13 via a molybdenum foil 12.

Mercury is added to the emission part 8 as the emission material and furthermore, a rare gas such as argon, xenon, or the like is added as the starting gas for luminous operation. For example, $1.3\times10^4$ Pa rare gas is added. The amount of mercury added here is preferably greater than or equal to 0.16 g/mm$^3$. At this amount, the mercury vapor pressure in stable luminous operation is greater than or equal to a hundred and some dozen atm. Furthermore, a halogen can be added to suppress blackening of the inside wall of the emission part 8.

One example of one such super-high pressure mercury lamp in accordance with the present invention is described below. Of course, in other embodiments, the details as described below may be different.

For the emission part 8 of the present example, the maximum diameter of the emission part is 12.0 mm, the maximum inside diameter is 7.5 mm and the length of the emission space, i.e. the length in the axial direction of the lamp, is 12.5 mm. The amount of mercury added is 50 mg. The inside volume of the emission space is 260 mm$^3$. The internal area of the emission space is 250 mm$^2$. The wall load is 0.8 W/mm$^2$. Furthermore, the rated wattage is 200 W and the distance between the electrodes 9, 10 is 1.5 mm.

Figure 4:
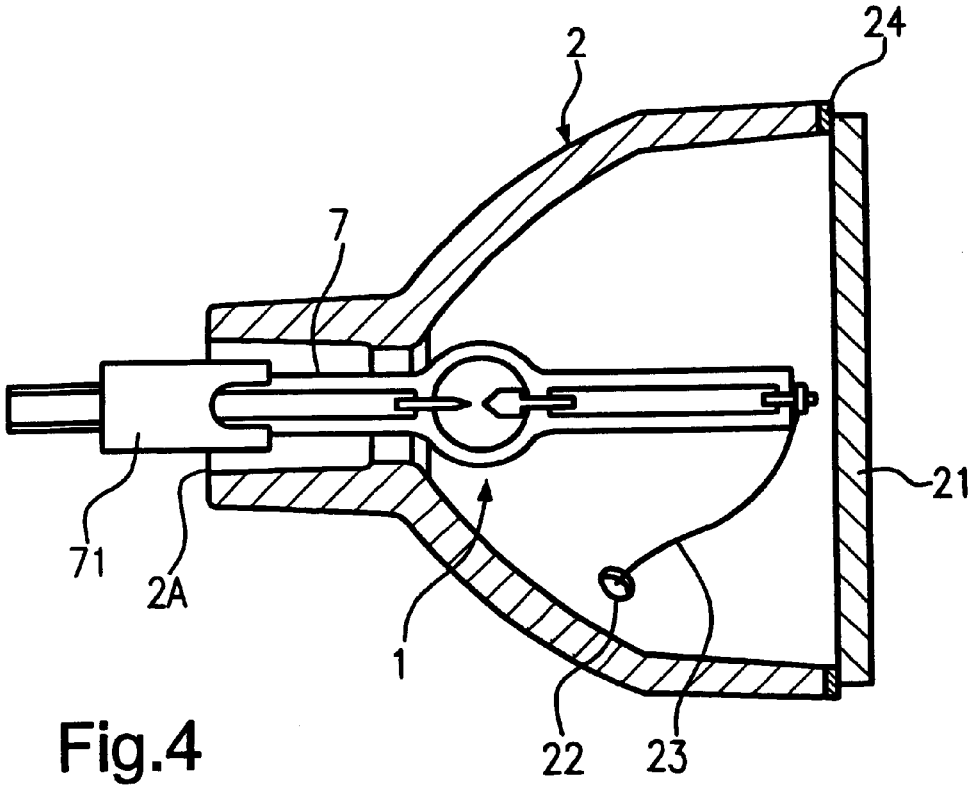
FIG. 4 shows a schematic illustration of a light source device.

This super-high pressure mercury discharge lamp 1 is installed in a concave reflector 2 in the manner shown in FIG. 4. The concave reflector 2 is provided with a front opening which is provided with a front cover 21 of translucent material. Thus, a light source device 200 is formed with the arrangement as shown in FIG. 4.

The hermetically sealed portion 7 of the super-high pressure mercury discharge lamp 1 projects over the rearmost part 2A in the middle opening of the concave reflector 2, and is attached using an adhesive in the concave reflector 2. One end of the hermetically sealed portion 7 of the super-high pressure mercury discharge lamp 1 is provided with a base 71 which has a terminal screw. One side of the concave reflector 2 is provided with an opening 22 from which a metallic line 23 is routed to supply electrical power to the outer lead 13 on the anode 9. Thus, a stipulated power is supplied.

The concave reflector 2 is preferably made of a heat-resistant hard glass, for example of borosilicate glass, and has a parabolic or oval shape. The front opening, for example, may have a square shape.

The inner surface of the concave reflector 2 may include a dielectric multilayer film in which, for example, titanium oxide ($TiO_2$) and silicon dioxide ($SiO_2$), are deposited in alternation on top of one another by an evaporation method. The thickness of the respective dielectric film and the number of layers are fixed such that radiation in the UV range and in the infrared range are passed while only visible radiation is reflected. Thus, a reflection surface is formed. The front cover 21 may be cemented to the front opening of the concave reflector 2 using an adhesive 24 such as, for example, an adhesive based on silicone resin.

As can be seen, the optical axis of the concave reflector 2 preferably coincides with the lengthwise axis of the super-high pressure mercury discharge lamp 1. In addition, the discharge lamp 1 is preferably arranged such that the emission center of the super-high pressure mercury discharge lamp 1 is located in the focal position of the concave reflector 2. Therefore, the radiant light from the super-high pressure mercury discharge lamp 1 can be emitted in the direction of the front opening of the concave reflector 2 with high efficiency.

Figure 5:
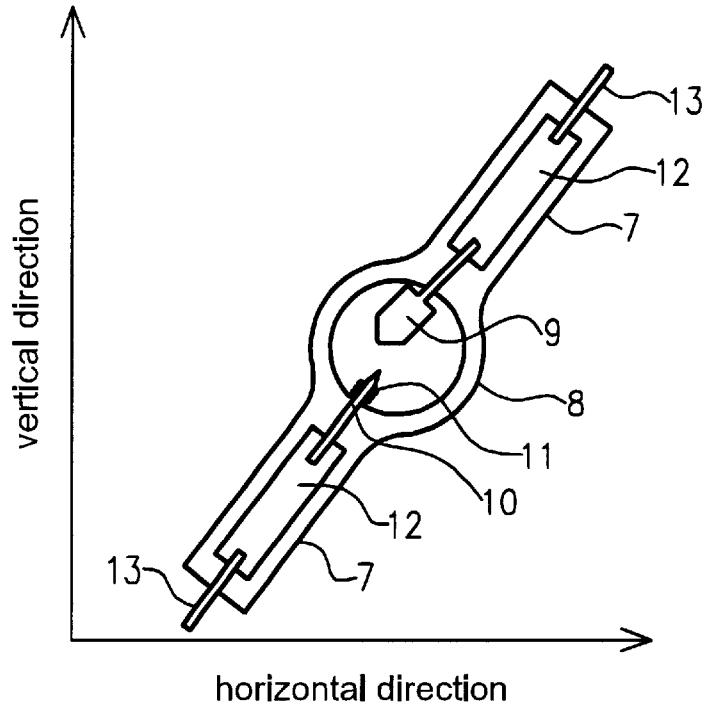
FIG. 5 shows a schematic illustration of the position of one example discharge lamp in accordance with the present invention.

Luminous operation of the discharge lamp 1 in accordance with the present invention is carried out with the discharge lamp tilted at a certain angle with respect to the vertical operating position in which the anode 9 is at the top and the cathode 10 is at the bottom. This angle between the vertical axial direction in a conventional arrangement of the discharge lamp with the anode located exactly over the cathode, and the axial direction when the discharge lamp is tilted out of the vertical axial direction obliquely in the direction to the rear reflector as shown in FIG. 5, is hereinafter referred to as the tilt angle. This tilt angle could also be defined as the angle between the vertical plane which includes the screen, and a plane which includes the lengthwise axis of the discharge lamp 1 or the concave reflector 2.

The eccentricity of the anode 9 is defined as the tip of the anode 9 lying outside the obliquely running plane which includes the lengthwise axis of the discharge lamp in the manner shown. In other words, as can be clearly seen in FIG. 5, the anode 9 is positioned offset or out of alignment with the cathode 10 and the lengthwise axis of the discharge lamp 1. This offset is referred to herein as the eccentricity of the anode 9. As claimed in the present invention, the tip of the anode 9 is shifted into a plane which, viewed from the rear reflector 3, is underneath the obliquely tilted plane which comprises the lengthwise axis of the discharge lamp 1.

The eccentricity direction will be defined below as the direction in which the tip of the anode 9 is shifted relative to the oblique tilt plane which comprises the lengthwise axis of the discharge lamp 1. In this regard, it should be evident by comparing FIG. 5 with FIG. 6 that each show anodes 9 with different eccentricity directions from one another. If the direction of tilt of the discharge lamp 1 from the vertical state and the eccentricity direction are the same, the tip of the anode 9 is located underneath the tilt plane and the tip of the anode 9 is thus, farther away from the rear reflector 3 than if it were located on the lengthwise axis of the discharge lamp 1.

Figure 6:
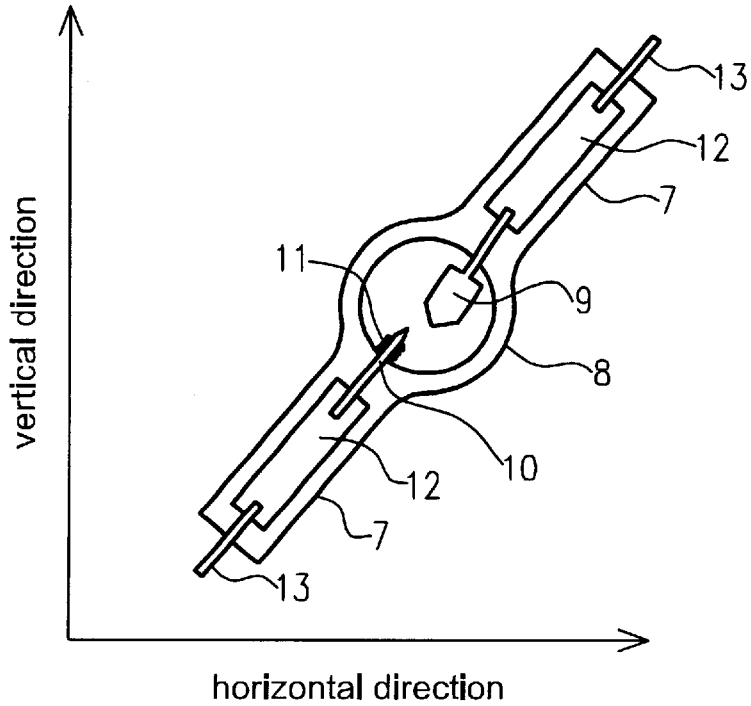
FIG. 6 shows a schematic illustration of the position of another example discharge lamp in accordance with the present invention.
Figure 7:
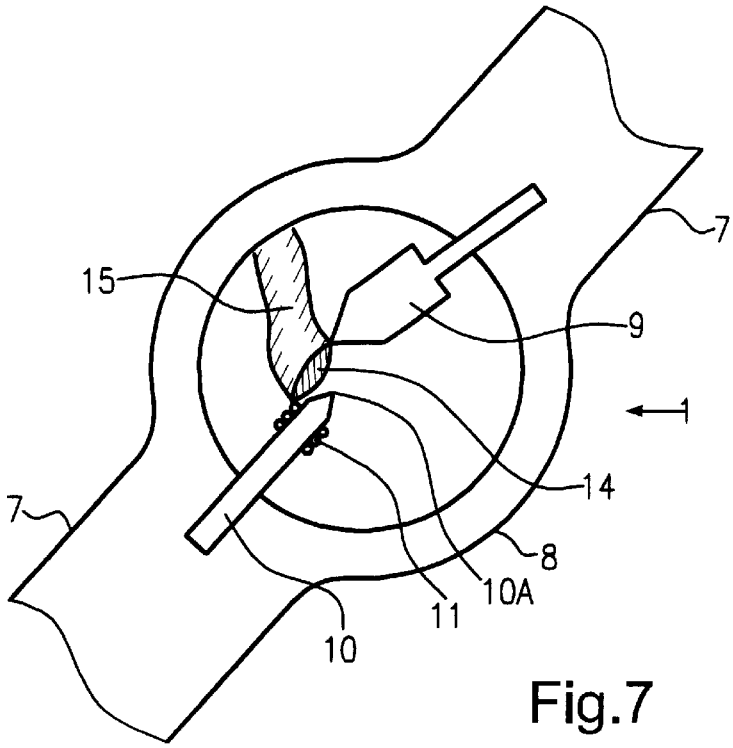
FIG. 7 shows an enlarged schematic illustration of the discharge state in the example discharge lamp of FIG. 5.

Specific phenomena are described below using the example shown in FIG. 5 in which the eccentricity direction of the anode 9 is on the side opposite the tilt direction with respect to the vertical state, and also using the example shown in FIG. 6 in which the eccentricity direction of the anode 9 and the tilt direction with respect to the vertical state are identical to one another. The electrodes 9, 10 and their vicinity as shown in FIGS. 5 and 6 are each shown in an enlarged representation in FIGS. 7 and 8, both of which omit the molybdenum foils for the sake of clarification.

When the discharge lamp 1 is started, generally there are many cases in which the hot spot of the discharge is formed in a coil 11, the coil 11 having a lower heat capacity than the cathode 10 so that thermal electron emission takes place easily. When the temperature in the tube lamp increases, the temperature of part of the upholding part of the cathode is likewise increased at the same time as a result of heat conduction from the coil 11 and as a result of convection from the arc 14 or a flare 15 in the vicinity of the arc, by which in the region of the upholding part of the cathode a discharge hot spot can also form. In doing so the discharge hot spot is shifted from the coil 11 to the tip 10A of the upholding part of the cathode, the minimum discharge gap being obtained. This is a general phenomenon which can be seen when starting a discharge lamp.

In the emission part 8 of the discharge lamp 1, during operation of the arc which has the highest temperature, convection takes place vertically upward, and a flow which moves down is formed along the inside wall.

In the case where the tilt direction and eccentricity direction of the anode 9 are as shown in FIG. 5, convection leads to raising of the discharge which has formed in the coil 11 in the direction opposite the force of gravity. The discharge is therefore stabilized in the direction which is remote from the tip of the cathode 10. The electrodes 9, 10 and their vicinity are shown enlarged in FIG. 7. Here, the tip 10A of the cathode 10 is not exposed to the high temperature atmosphere due to convection from the arc 14 or from the flare 15 that is in the vicinity of the arc 14, so that, correspondingly, the opportunity to raise the temperature of the cathode 10 and the cathode tip 10A is lost. The discharge hot spot cannot be shifted to the tip 10A of the cathode 10, and the arc 14 on the coil 11 continues to exist. In this way, the coil 11 with low heat capacity is vaporized and the vaporized tungsten adheres to the inside wall of the emission part 8. In this area of the emission part 8, the light transmission factor is thereby reduced. Furthermore, the quartz glass is decomposed or deformed by heat absorption which adversely affects the discharge lamp's 1 properties.

Figure 8:
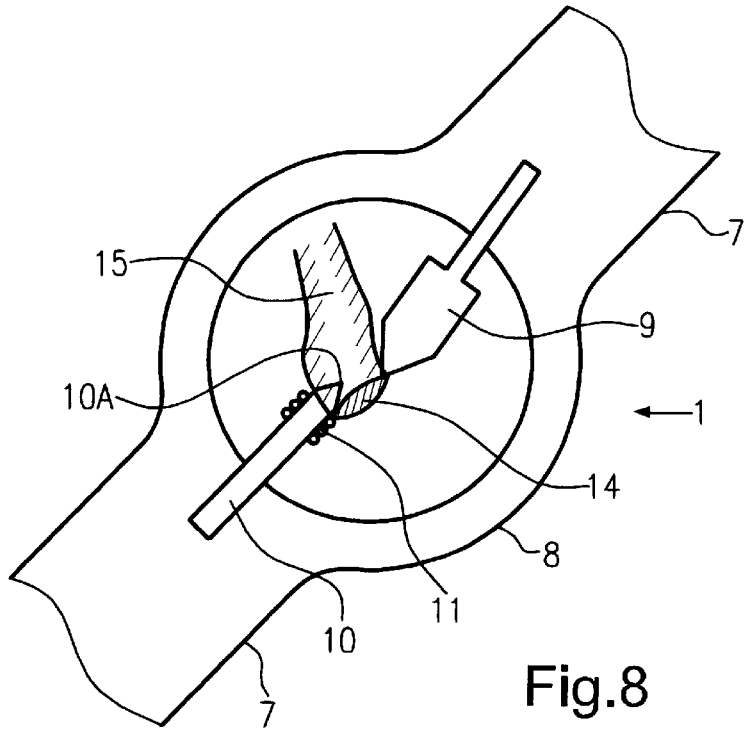
FIG. 8 shows an enlarged schematic illustration of the discharge state in the example discharge lamp of FIG. 6.

In the case where the tilt direction and the eccentricity direction of the anode 9 of the discharge lamp 1 is as shown in FIG. 6, converse applies. In particular, the tip 10A of the cathode 10 is exposed to the flare 15 having a high temperature even if the discharge which has formed in the coil 11 has been raised by convection and is located above the coil 11. The electrodes 9, 10 and their vicinity are shown enlarged in FIG. 8. As can be seen in FIG. 8, the flare 15 causes the temperature to be increased and the discharge is shifted to the tip 10A of the cathode 10 in the manner shown. This eliminates the continuation of the discharge in the coil 11 and therefore, as a result of the efficient construction between the tip 10A of the cathode 10 and the tip of the anode 9, a discharge forms at the desired tips of the cathode 10 and the anode 9 so that the desired discharge property can be obtained in the discharge lamp 1.

As is evident from the discussion above, the eccentric arrangement of the tip of the anode 9 can be achieved, for example, by the anode 9 being attached obliquely relative to the lengthwise axis of the discharge lamp 1. Of course, the anode 9 itself may be secured in the hermetically sealed portion 7 aligned with or oblique to the lengthwise axis of the discharge lamp 1, as long as the tip of the anode 9 is eccentrically arranged in the manner described.

Therefore, operation of the light source device 200 and the discharge lamp 1 which is tilted with respect to vertical, can take place in a wide range. But in the case of a tilt of greater than 50 degrees with respect to the vertical axis, the vapor pressure of the mercury of the super-high pressure mercury discharge lamp 1 cannot always be increased sufficiently. Therefore, the desired lamp characteristic cannot always be obtained. Furthermore, the position of the region with the highest temperature of the emission part 8 can be changed by an overly large tilt angle. This can lead to evident devitrification of the quartz glass.

In the case of a small tilt angle of the light source device 200 of less than 5 degrees relative to the vertical axis, as in vertical luminous operation, the problem of a continuing coil arc ordinarily does not arise, even if installation takes place without considering the relation between the direction of tilted operation and the eccentricity direction of the anode 9. In practice, therefore, the preferred effective region of tilted operation in the invention is greater than or equal to 5 degrees and less than or equal to 50 degrees with respect to the vertical axis.

The super-high pressure mercury discharge lamp 1 preferably used as described above operates on direct current and as a lamp wattage of greater than or equal to 100 W. For a lamp wattage of less than 100 W, the radiance required by the market ordinarily cannot be obtained. Feasibly greater than or equal to 0.16 mg/mm mercury, and a rare gas or a rare gas and halogen are added to the emission part 8 and the wall load is preferably greater than or equal to 0.8 W/mm$^2$. In order to obtain a point light source with high radiance, it is feasible to add greater than or equal to 0.16 mg/mm$^3$ of mercury. Furthermore, it is preferred that the wall load is greater than or equal to 0.8 W/mm$^2$ in order to completely vaporize the added mercury.

Thus, by establishing the arrangement of the tilted direction of operation and the eccentricity direction of the electrodes 9, 10 such that the tip of the anode 9 is positioned on the side on which the light source device 200 is located in a tilted orientation with respect to the lengthwise axis of the discharge lamp 1, the continued existence of a coil arc is prevented like vertical luminous operation. Thus, a steady-state arc between the tips of the anode 9 and cathode 10 is obtained and stabilized.

By fixing the tilt angle of luminous operation, the same lamp characteristic as in vertical luminous operation can be ensured and the light source device 200 can be used in conditions under which the heat load of the emission part 8 does not exceed the allowable temperature range.

Furthermore, by using a super-high pressure discharge lamp of the direct current operating type with a lamp wattage of greater than or equal to 100 W in which greater than or equal to 0.16 mg/mm$^3$ mercury, and a rare gas or a rare gas and halogen are added to the emission part 8, and by providing a wall load preferably greater than or equal to 0.8 W/mm$^2$, sufficient radiance is obtained in which the added mercury is completely vaporized for an irradiation source of a video monitor of the rear projection type a light source device 200.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications.

We claim:

1. A light source device for a video monitor of the rear projection type, in which light is emitted in a direction of a tilted rear reflector and is reflected onto a substantially vertical screen, said light source device comprising:

a concave reflector with a middle opening and an optical axis, said optical axis being positioned tilted obliquely out of a plane substantially parallel to the substantially vertical screen in a direction of the rear reflector; and a discharge lamp operable via application of direct current, said discharge lamp including an emission part with a cathode and an anode located opposite to one another and being supported by hermetically sealed portions of said emission part, one of said hermetically sealed portions being mounted in said middle opening of said concave reflector in a manner that a lengthwise axis of said discharge lamp substantially aligns with said optical axis of said concave reflector;

wherein said anode of said discharge lamp is positioned closer to the rear reflector than said cathode of said discharge lamp, and a tip of said anode is positioned underneath an obliquely tilted plane that includes said lengthwise axis of said discharge lamp.

2. Light source device as claimed in claim 1, wherein said optical axis of said concave reflector is tilted obliquely toward a middle of the rear reflector.

3. Light source device as claimed in claim 1, wherein a tilt angle of said optical axis of said concave reflector is greater than or equal to 5 degrees, and less than or equal to 50 degrees, with respect to the plane substantially parallel to the screen.

4. Light source device as claimed in claim 2, wherein a tilt angle of said optical axis of said concave reflector is greater than or equal to 5 degrees, and less than or equal to 50 degrees, with respect to the plane substantially parallel to the screen.

5. Light source device as claimed in claim 1, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

6. Light source device as claimed in claim 2, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

7. Light source device as claimed in claim 3, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

8. Light source device as claimed in claim 4, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

9. A light source device for a video monitor of the rear projection type, in which light is emitted in a direction of a tilted rear reflector and is reflected onto a substantially vertical screen, said light source device comprising:

a concave reflector with a middle opening and an optical axis, said optical axis being positioned tilted obliquely out of a plane substantially parallel to the substantially vertical screen in a direction of the rear reflector; and a discharge lamp operable via application of direct current, said discharge lamp including an emission part with a cathode and an anode located opposite to one another and being supported by hermetically sealed portions of said emission part, one of said hermetically sealed portions being mounted in said middle opening of said concave reflector in a manner that a lengthwise axis of said discharge lamp substantially aligns with said optical axis of said concave reflector;

wherein said anode of said discharge lamp is positioned at an eccentricity relative said lengthwise axis so that a tip of said anode is positioned offset relative to said cathode and is underneath an obliquely tilted plane that includes said lengthwise axis of said discharge lamp.

10. Light source device as claimed in claim 9, wherein a tilt angle of said optical axis of said concave reflector is greater than or equal to 5 degrees, and less than or equal to 50 degrees, with respect to the plane substantially parallel to the screen.

11. Light source device as claimed in claim 10, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

12. Light source device as claimed in claim 9, wherein power wattage of said discharge lamp is greater than or equal to 100 W, said emission part contains greater than or equal to 0.16 mg/mm$^3$ mercury, and contains at least one of a rare gas and a halogen, and wherein wall load of said emission part is greater than or equal to 0.8 W/mm$^2$.

* * * * *